United States Patent [19]

Chaffin

[11] 4,211,359

[45] Jul. 8, 1980

[54] AUTOMATIC MULTICELL CARTON

[75] Inventor: Richard Chaffin, Port Clinton, Ohio

[73] Assignee: Clevepak Corporation, White Plains, N.Y.

[21] Appl. No.: 47,243

[22] Filed: Jun. 11, 1979

[51] Int. Cl.[2] ..... B65D 5/48

[52] U.S. Cl. ..... 229/28 R; 229/41 B

[58] Field of Search ..... 229/28 R, 28 BC, 41 B, 229/41 R

[56] References Cited

U.S. PATENT DOCUMENTS

| | | | |
|---|---|---|---|
| 2,880,921 | 4/1959 | Persson | 229/41 B X |
| 3,039,672 | 6/1962 | Kuchenbecker | 229/28 R |
| 3,921,894 | 11/1975 | Hackenberg | 229/41 B X |
| 3,941,302 | 3/1976 | Tyrseck | 229/15 X |

FOREIGN PATENT DOCUMENTS

| | | | |
|---|---|---|---|
| 573451 | 4/1959 | Canada | 229/28 R |
| 94309 | 5/1959 | Norway | 229/28 R |

*Primary Examiner*—Davis T. Moorhead

*Attorney, Agent, or Firm*—Cushman, Darby & Cushman

[57] ABSTRACT

A collapsible multicell carton constructed from a single blank. The carton includes four side panels, four partition panels and four bottom panels, the side panels being hingedly connected end-to-end and corresponding partition and bottom panels being respectively hingedly connected to the side panels. Specially shaped slots in two transverse partition panels and two bottom panels of the carton permit two longitudinal partition panels to slide easily in and out of position through the slots s the carton is opened and collapsed. Gluing is required only between partitions and two of the side panels and not at the bottom. Two embodiments of the invention include a four cell carton and a six cell carton.

19 Claims, 17 Drawing Figures

252
248
254
304
212
218

AUTOMATIC MULTICELL CARTON

The invention relates to a multicell carton and more particularly to a four or six cell collapsible carton constructed from a single blank.

BACKGROUND OF THE INVENTION

Collapsible multi-cell cartons constructed from a single blank are well known. See, for example, U.S. Pat. No. 3,039,652 issued to Kuchenbecker on June 19, 1962 which shows a six cell collapsible tray. Prior art trays such as Kuchenbecker and other cartons have several disadvantages. Their assembly from blank requires several steps including several gluing steps. The bottom panels of such prior cartons are either glued or hook fastened. Many of the blanks from which the prior cartons are assembled have shapes which result in substantial waste of the material from which the blank is cut. Many of the prior art devices also require a substantial amount of force to overcome mechanical hang-ups when opening a collapsed carton into its assembled form.

A collapsible six-cell carton cut from a single blank manufactured by Champion Packages is formed with three cells on each side of a longitudinal partition. The bottom includes four panels each hingedly connected on an outside edge to the bottom edge or vertical side of the carton, and on the inside opposing edge to one of four internal panels forming the partitions. Flaps hingedly attached to side edges of two of the bottom panels are glued to the other two bottom panels to form what is known as a "Himes bottom". The four vertical sides of the carton are hingedly connected end-to-end. Two of the internal panels are positioned transversely to the left of the carton in order to separate the cells longitudinally. The transverse internal panels are positioned transversely to the left of the carton in order to separate the cells longitudinally. The transverse internal panels have centrally located vertical slots which extend into the adjacent bottom panels to which they are respectively hingedly attached. The other two internal panels are positioned longitudinally the length of the carton, half of each passing through one of the above-mentioned slots in order to create two cells at each end of the carton and the other half of each longitudinal internal panel overlapping in the center of the carton and hingedly fixed to the opposite transverse internal panel to create two centrally located cells. When two catercorner vertical edges of the carton are forced together, a hydraulic movement of the transverse interior panels and a concurrent withdrawal of the longitudinal interior panels from the outer cells through the slots occurs. The bottom outer edges of the interior longitudinal panels are curved upward and one of the vertical edges in each of the slots is vertically and longitudinally cut without curves so that the upward curving edges of the longtudinal interior panels act as cams and the transverse internal panels act as cam followers during the hydraulic movement. At the same time, two of the bottom panels are drawn upward pushing the other two panels to which they are glued until the carton is fully collapsed so that each connected internal panel—bottom panel pair rests flush against the side panel to which they are hingedly joined. By reversing the pressure on the catercorners, the carton snaps back open. One disadvantage of the Champion carton is that its construction requires five gluing steps including the gluing of two bottom panels to the other two bottom panels. This gluing limits somewhat the hydraulic movement of the panels during opening and closing. Another disadvantage of the Champion carton is that the transverse interior panels have upward curved outer bottom edges so that the outer portions of these panels do not completely partition the cells on opposite sides thereof. As a result, objects stored in these cells may not be completely protected from contact with each other.

SUMMARY OF THE INVENTION

The present invention consists of a collapsible multicell square or rectangular carton constructed from a single blank which accomplishes a number of improvements over prior collapsible cartons. In a number of respects the present invention is similar to the Champion carton but includes a number of important improvements thereover. In accordance with the present invention, the basic concepts of the Champion carton are improved by eliminating the bottom panel gluing flaps so that all of the bottom panels are disconnected from each other and cutting the slots in the bottom panels of the carton in a curved shape so that one edge of each of these slots operates as a cam on which the transverse panels may slide when the carton is being assembled or collapsed. As a result of this construction, the interior transverse panels may be made completely rectangular so that they completely partition the carton's cells. Also, the present invention recognizes that purely hydraulic motion will assemble and collapse the carton in a smooth manner and eliminate two gluing steps by excluding the Himes bottom of the Champion carton without any reduction in the strength of the carton. Finally, the present invention recognizes that the basic concept of the six cell carton may also be utilized in a four cell carton.

BRIEF DESCRIPTION OF THE DRAWING

Further advantages and details of the present invention will be apparent from the following detailed description and accompanying drawings wherein.

DETAILED DESCRIPTION OF THE PREFERRED EMBODIMENT

Figure 1:
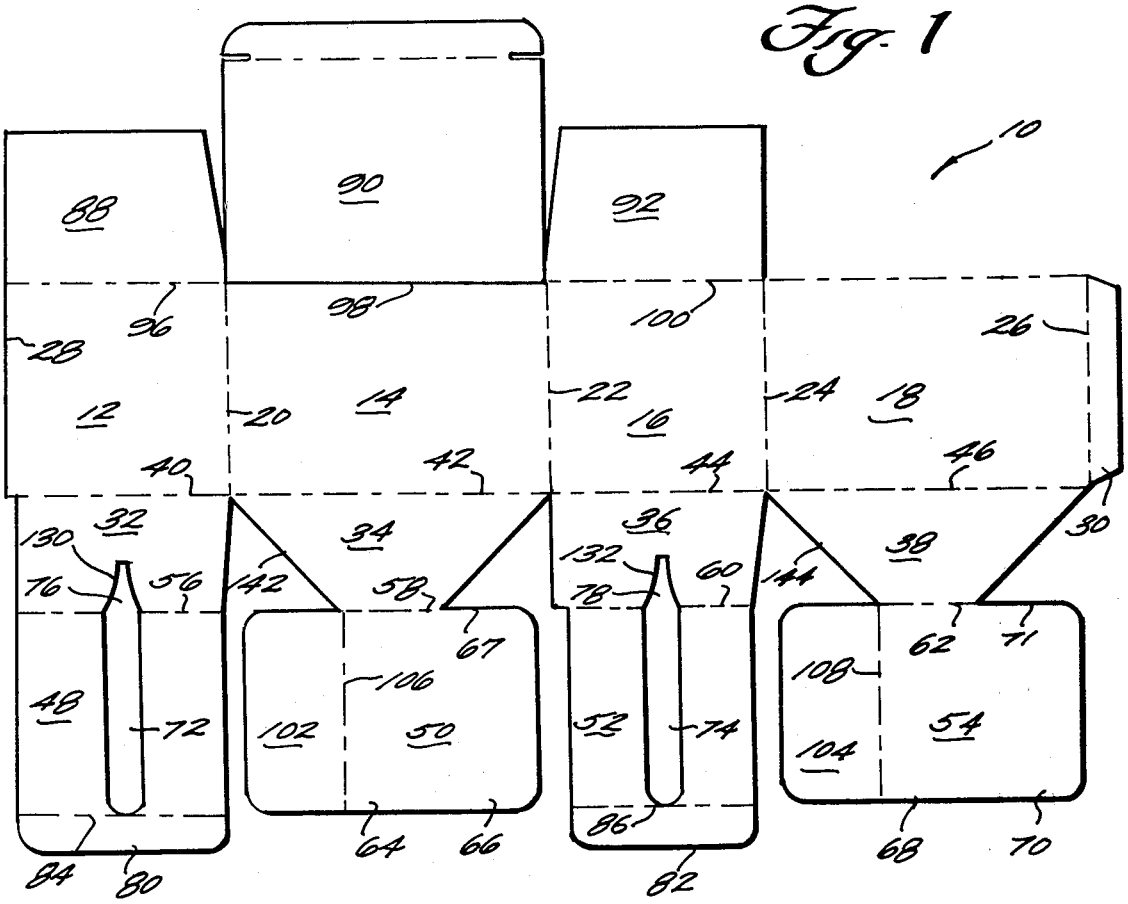
FIG. 1 is a plan view of a blank suitably scored and cut for making the six cell carton of a first preferred embodiment of the invention.
Figure 3:
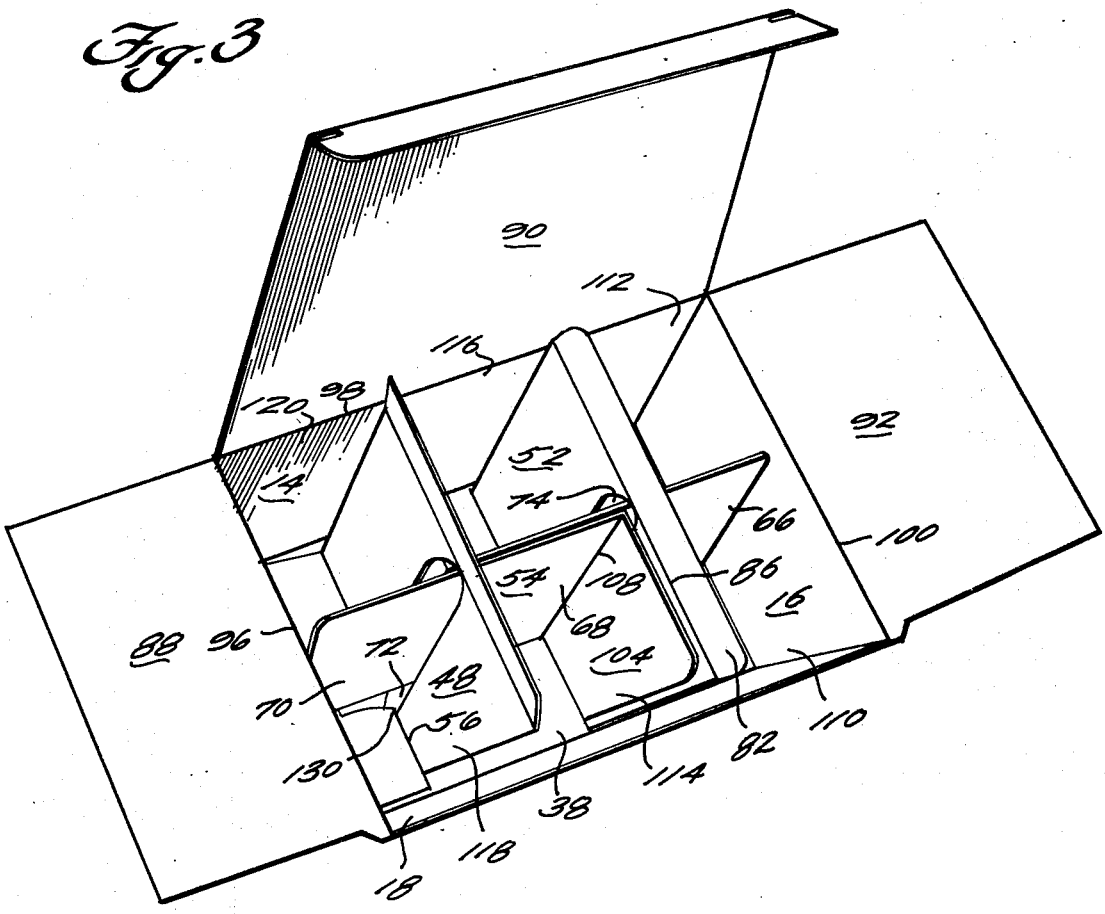
FIG. 3 is a perspective view of the first carton in its completed open form.
Figure 4:
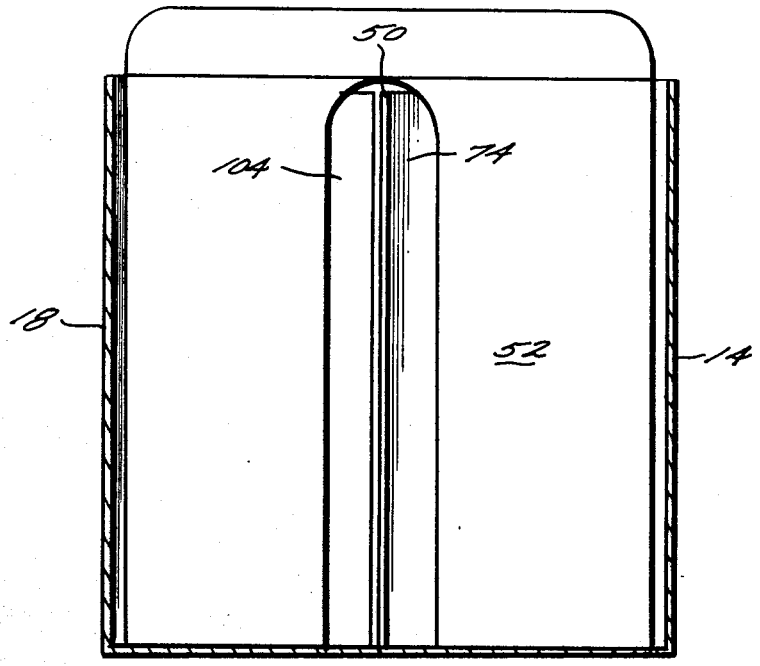
FIG. 4 is a side view of the first carton with one side panel of the carton cut away.
Figure 7:
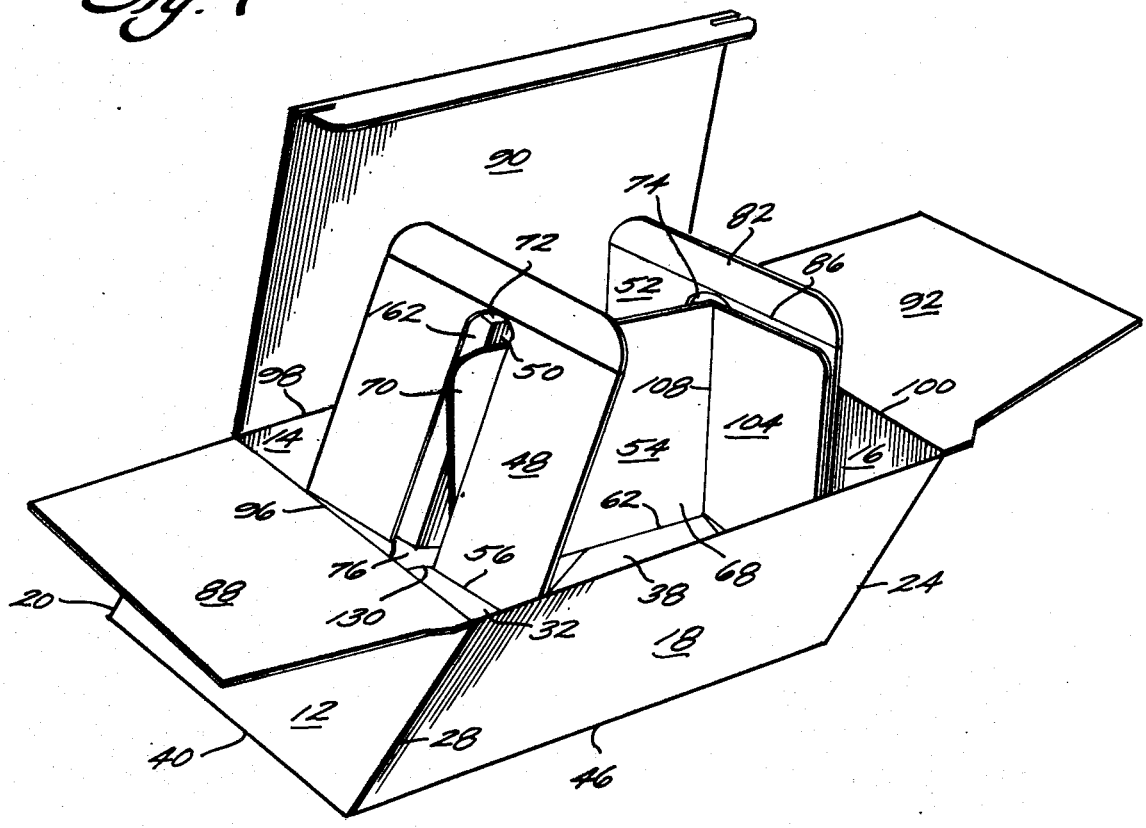
FIG. 7 is a perspective view of the first carton partially collapsed.

Referring to FIG. 1, the carton is formed in accordance with a first six-cell embodiment of the invention preferably from a single blank 10 of suitable flexible sheet material, such as cardboard. The blank is suitably cut and scored to provide rectangular side panels 12, 14, 16 and 18, hingedly joined end-to-end at hinges 20, 22 and 24. Means for joining outside edge 26 of panel 18 to outside edge 28 of panel 12 is suitably provided by tab 30 hingedly connected to panel 18 along edge 26. Panels 14 and 18 are identically shaped and form the longitudinal sides of the carton. Panels 12 and 16 are also identically shaped and form the transverse sides of the carton. Bottom panels 32, 34, 36 and 38 are respectively hingedly connected to side panels 12, 14, 16 and 18 at bottom edges 40, 42, 44 and 46. Bottom panels 32, 34, 36 and 38 are respectively hingedly connected to substantially rectangular interior panels 48, 50, 52 and 54 along respective bottom inside edges 56, 58, 60 and 62. Panels 34 and 50 are suitably respectively identically shaped to panels 38 and 54. Panels 32 and 48 are suitably respectively identically shaped to panels 36 and 52. In order that the assembled carton have six equal sized cells, panels 34 and 38 are suitable in the shape of an isosceles trapezoid with edges 58 and 62 having length respectively one-third the length of parallel edges 42 and 46. Longitudinal interior panel 50 has a central portion 64 directly above hinge 58 and an outside portion 66 which is free on three sides. Similarly, longitudinal interior panel 54 has a central portion 68 directly above hinge 62 and an adjacent outside portion 70 free on three sides. Panel outside portions 66 and 70 have straight bottom edges 67 and 71 which are respectively along their full length aligned with bottom made hinged edges 58 and 62. Transverse interior panels 48 and 52 respectively have centrally located vertical slits 72 and 74 having concavely rounded "V"-shaped end portions extending respectively into bottom panels 32 and 36. As is best shown in FIGS. 3 and 7, slits 72 and 74 are adapted to slidably receive longitudinal interior panel end portions 70 and 66 as will be described. Narrow interior upper flaps 80 and 82 are optionally respectively connected to transverse interior panels 48 and 52 along edges 84 and 86. Closure flaps 88, 90 and 92 are respectively connected to side panels 12, 14 and 16 along respective upper edges 96, 98 and 100. Menas for respectively attaching panels 50 and 54 to panels 52 and 48 at edges 106 and 108 are suitably provided by tabs 102 and 104 hingedly connected to panels 50 and 54 at edges 106 and 108.

Figure 2:
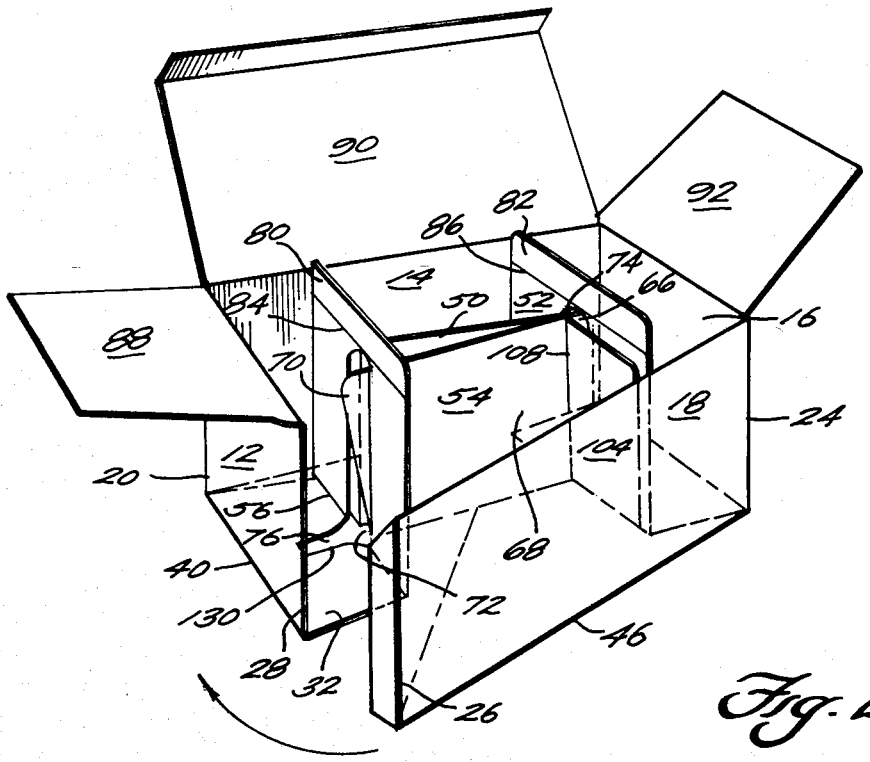
FIG. 2 is a perspective view of the blank shown in FIG. 1 folded and partially glued.
Figure 5:
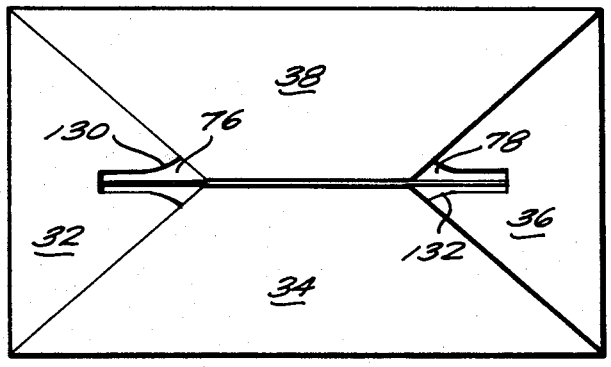
FIG. 5 is a bottom view of the first carton.

In order to assemble the carton, panels 48, 50, 52 and 54 are respectively bent over bottom panels 32, 34, 36 and 38 along respective hinges 56, 58, 60 and 62; side panels 12, 14, 16 and 18 are respectively bent over bottom panels 32, 34, 36 and 38 along respective hinges 40, 42, 44 and 46; flaps 88, 90 and 92 are respectively folded over side panels 12, 14 and 16 along respective hinges 96, 98 and 100; and flaps 102 and 104 are respectively folded over panels 50 and 54 along respective hinges 106 and 108. Panel 12 is folded over panel 16 along edge 22, panel 16 is folded over panel 14 along edge 20, panel 14 is folded over panel 18 along edge 24 and flap 30 is folded over panel 18 along edge 26. The carton blank, so folded is best illustrated in FIG. 2.

Figure 6:
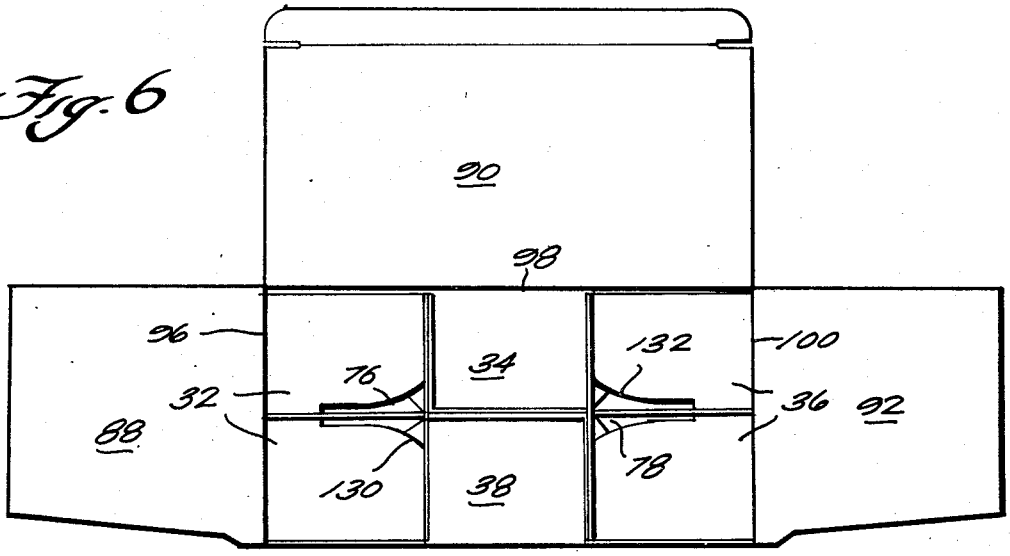
FIG. 6 is a top view of the first carton.

In order to assemble the folded blank, the respective outside portions 66 and 70 of panels 50 and 54 may first be respectively inserted through slots 74 and 72 and panels 102 and 104 suitably attached as by gluing to transverse interior panels 48 and 52 respectively. Flaps 102 and 104 are suitably mirrow images of outside portions 66 and 70 of longitudinal interior panels 50 and 54. With such a symmetrical design, the roles of flaps 102 and 104 and outer panel portions 66 and 70 may be reversed by placing the hinges 106 and 108 on the other side of hinges 58 and 60 respectively. Following the above-described insertion and gluing operation, flap 30 may be fixed as by gluing to panel 12 along edge 28 to complete the structure of the carton which is best illustrated in FIGS. 3 and 6. In its open assembled state the carton has six cells 110, 112, 114, 116, 118 and 120. Each cell is bound on two opposing sides and its bottom by three panels connected end-to-end. Cells 110 and 112 are each bound on two opposing sides by side panel 16 an interior panel 52 and bound at its bottom by panel 36. Outside portion 66 of longitudinal interior panel 50 separates the two cels. Similarly, cells 118 and 120 are bound on two opposing sides by side panel 12 and interior panel 48 and bound at its bottom by bottom panel 32. Outside panel 70 of longitudinal interior panel 54 separates the two cells. Cell 116 is bound on opposing sides by inside portion 66 of longitudinal interior panel 50 and the central portion of side panel 14 and bound at its bottom by bottom panel 34. Similarly, cell 114 is bound on two opposing sides by inside portion 68 of longitudinal interior panel 54 and the central portion of side panel 18 and bound at its bottom by bottom panel 38. Both cells 114 and 116 are bound at its other opposing sides by transverse interior panels 52 and 48.

Figure 8:
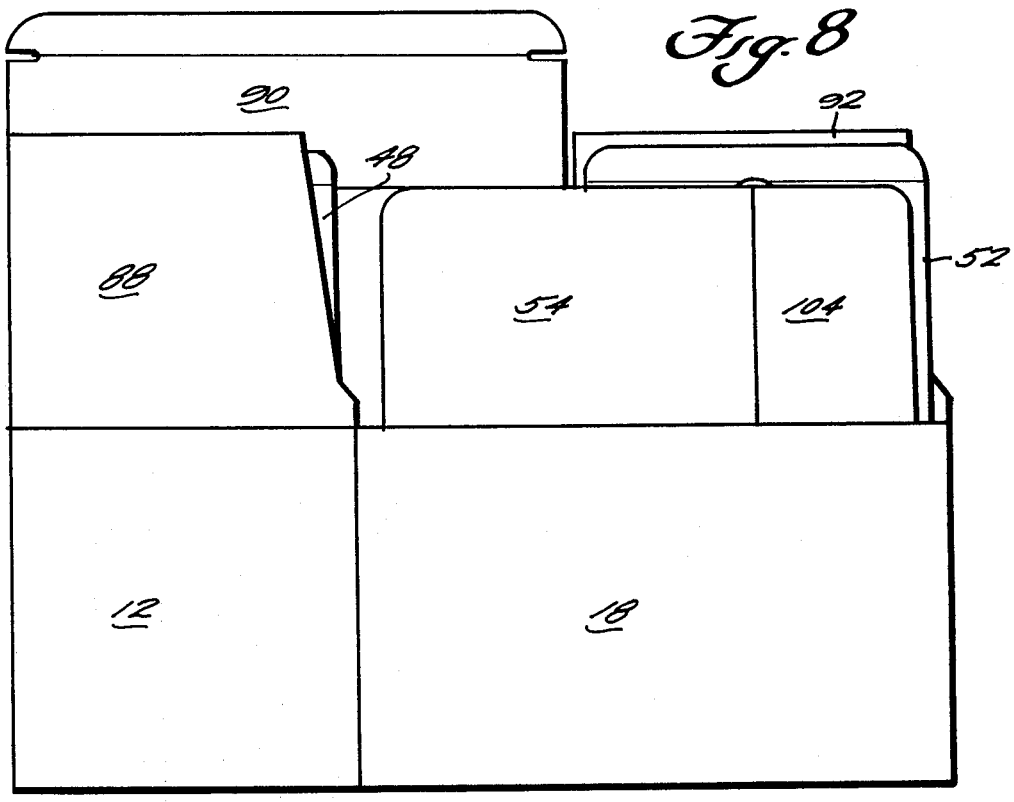
FIG. 8 is a side view of the first carton completely collapsed.

In order to collapse the carton, a light pressure may be applied at edges 22 and 28 which causes panels 50 and 54 to respectively slide out from the spaces corresponding to cells 110, 112 and 118, 120 through respective slots 74 and 72. Concurrently, transverse interior panels 48 and 52 are caused to twist in a counterclockwise direction, bottom panels 32 and 36 respectively rotate upward about hinges 40 and 44, bottom panels 34 and 38 are respectively bent upward about hinges 42 and 46 until panels 50 and 54 are respectively completely removed from slots 74 and 72, and the various interior and bottom panels are flattened against the corresponding panel which they connectedly oppose when the carton is in its open position. During the collapsing operation, angular edges 142 and 144 of bottom panels 34 and 38 respectively apply substantially constant upward pressure on bottom panels 32 and 36 to cause the respective panels to rotate upward in unison. A reverse action occurs when the carton is opened. The degree and consistency of the pressure will vary somewhat depending on the rigidity of the panel material. The carton in its partially and completely collapsed state is respectively shown in FIGS. 7 and 8.

The easy removal of panels 50 and 54 from slots 74 and 72, respectively, without substantial force or bending or panels is accomplished by cutting the bottom portion 76 and 78 of slots 72 and 74 in the shape of a "V" with the upper sides of the "V" curved inwardly. For proper operation, it is actually only necessary that the curved edges 130 and 132, which are closest to the edges 28 and 22 when the carton is in its assembled state, where pressure is applied during the opening and collapsing of the carton, be so shaped since it is these curved edges which press against longitudinal interior outside portions 66 and 70 during opening and collapsing of the carton. It is found that the rounded shape of these edges keeps panels 50 and 54 flat and unobstructed while they are respectively sliding through slots 74 and 72. Because edges 130 and 132 operate as cams against surface of panels 52 and 54 during collapsing and assembly of the carton, bottom edges 67 and 71 may be straight so that panels 52 and 54 completely separate the cells on the opposite sides thereof without interfering with smooth assembling and collapsing of the carton. For the sake of a symmetrical appearance and the ability to reverse the functions of flaps 102 and 104 with those longitudinal interior panel outside portions 66 and 70, respectively, slot portions 76 and 78 each have symmetrical curved "V"-shaped edges.

Figure 9:
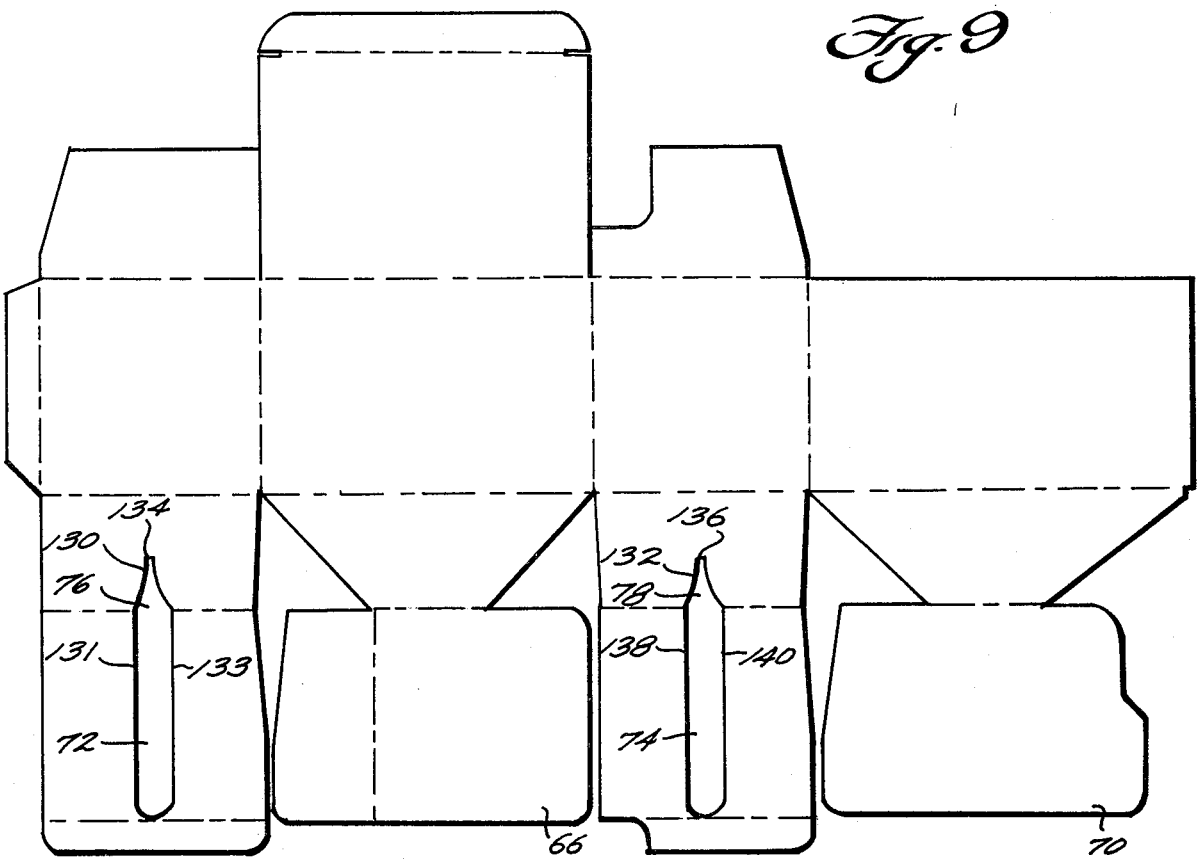
FIG. 9 is a plan view of a blank suitably scored and cut for making the six cell carton of a second embodiment of the invention.

FIG. 9 illustrates a second embodiment of the six-cell carton which includes a certain modification of the shapes of the bottom portions of the slots to makee "V" portions 76 and 78 nonsymmetrical. The same parts and edges of the second embodiment are identified with the same numerals as in the first embodiment. Referring to FIG. 9 it is noted that the tips 134 and 136 of V grooves 76 and 78 respectively are closer to slot edges 131 and 138 than to opposite slot edges 133 and 140. With such a design it is found that longitudinal panel outside portions 66 and 70 may respectively slide more smoothly inward and outward of slots 72 and 74 to open or collapse the carton.

Figure 10:
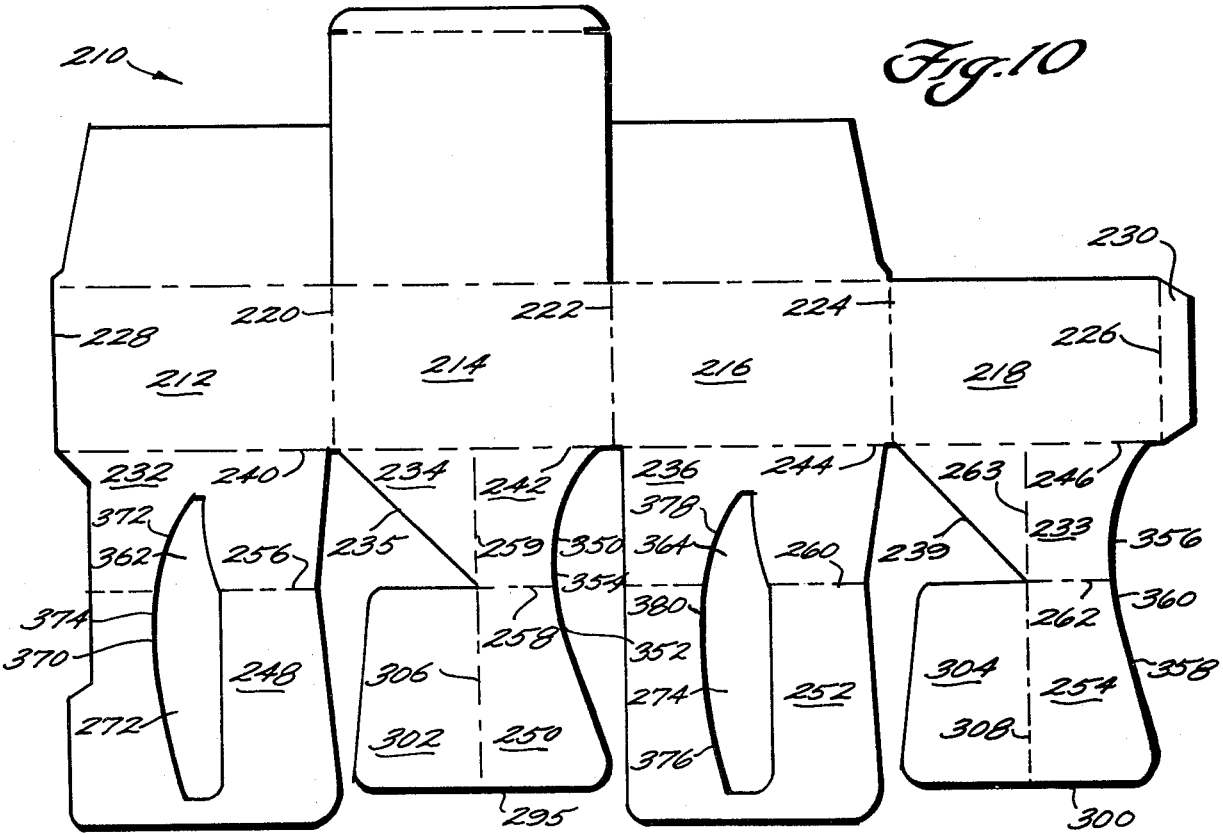
FIG. 10 is a plan view of a blank suitably scored and cut for making the four cell carton of a third preferred embodiment of the invention.
Figure 12:
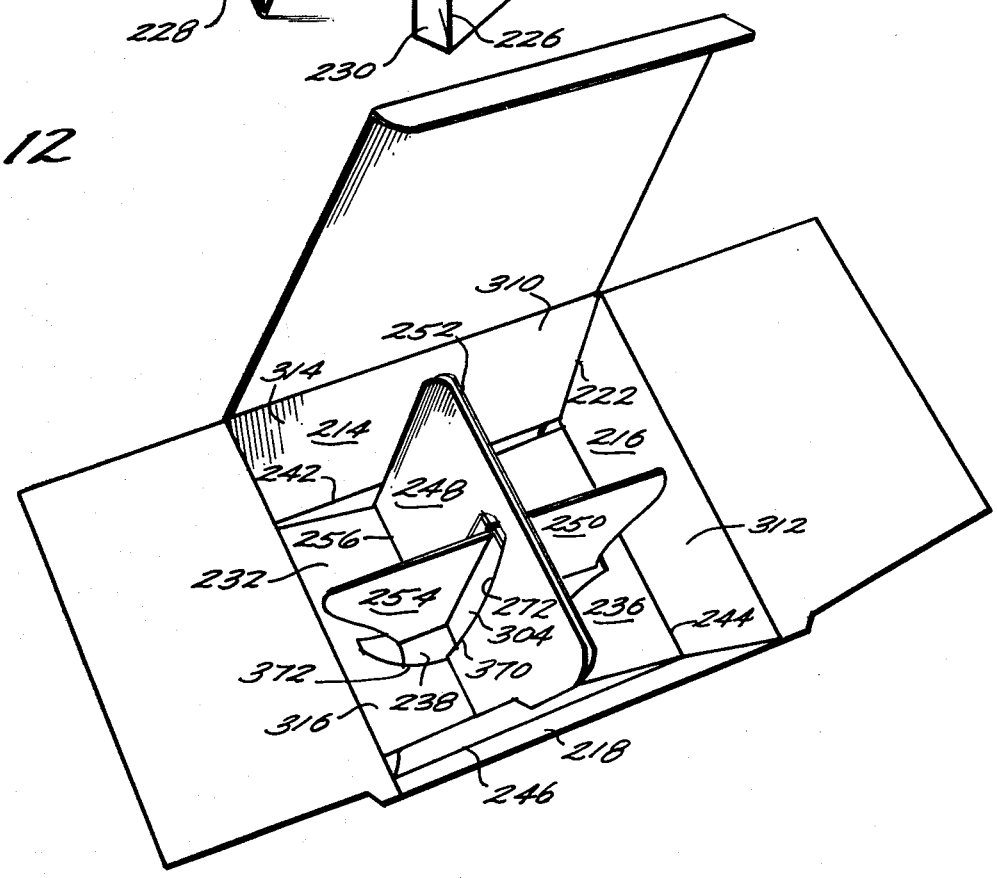
FIG. 12 is a perspective view of the third carton in its completed open form.
Figure 13:
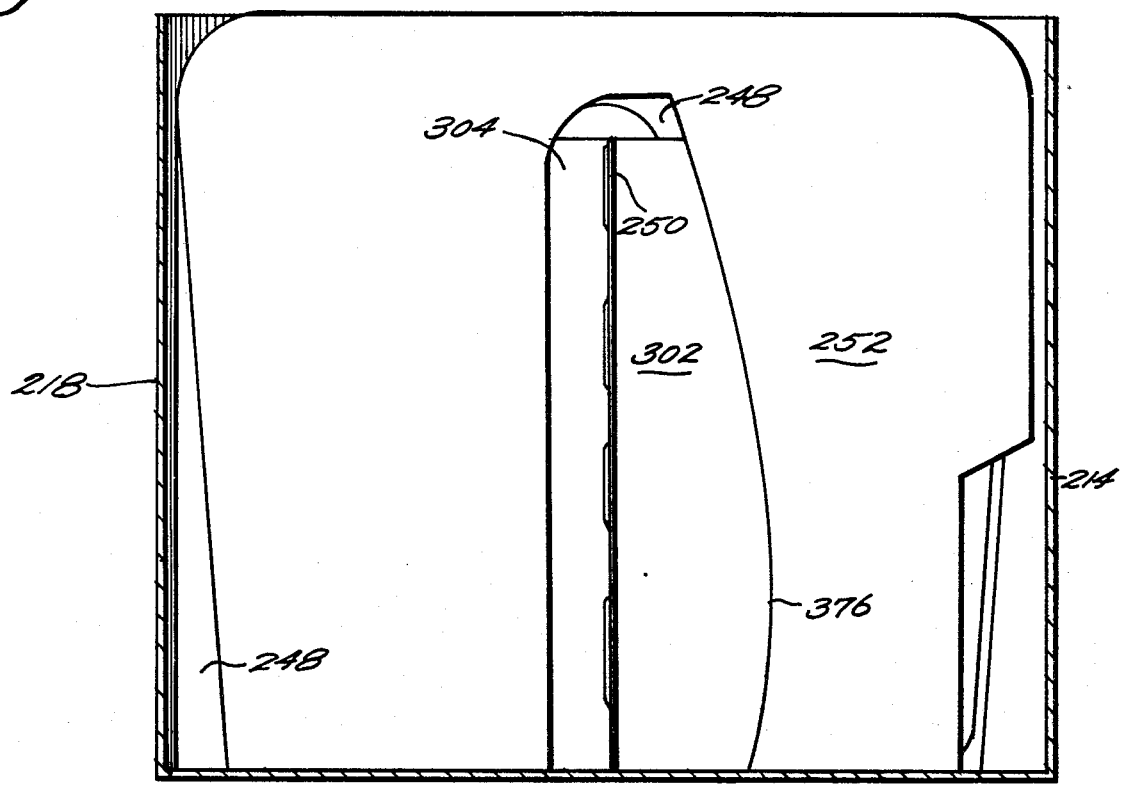
FIG. 13 is a side view of the third carton with one side panel of the carton cut away.
Figure 14:
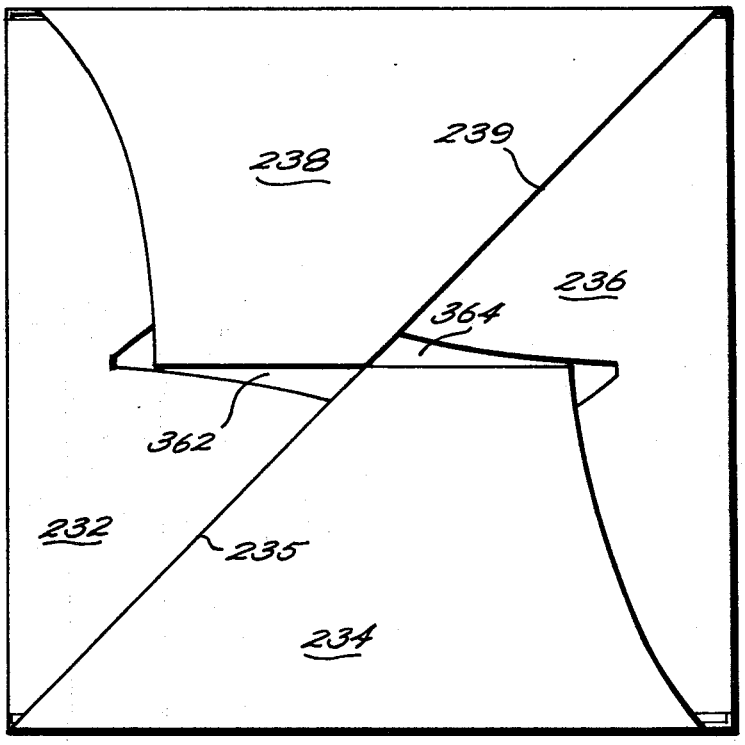
FIG. 14 is a bottom view of the third carton.

Referring now to FIG. 10, the carton is formed in accordance with a third four-cell embodiment of the invention preferably from a single blank 210 of suitable flexible sheet material, such as cardboard. The blank is suitably cut and scored to provide rectangular side panels 212, 214, 216 and 218, hingedly joined end-to-end at hinges 220, 222 and 224. Means for joining outside edge 226 of panel 218 to outside edge 228 of panel 212 is suitably provided by tab 230 hingedly connected to panel 218 along edge 226. Panels 214 and 218 are identically shaped and form the longitudinal sides of the carton; panels 212 and 216 are also identically shaped and form the transverse sides of the carton. In order that the carton be square in horizontal cross section panels 212, 214, 216 and 218 should be identically shaped. Bottom panels 232, 234, 236 and 238 are respectively hingedly connected to side panels 212, 214, 216 and 218 at bottom edges 240, 242, 244 and 246. Bottom panels 232, 234, 236 and 238 are respectively hingedly connected to interior panels 248, 250, 252 and 254 along respective bottom inside edges 256, 258, 260 and 262. Panels 234 and 250 are suitably respectively identically shaped to panels 238 and 254. Panels 232 and 248 are suitably respectively identically shaped to panels 236 and 252. In order that the assembled carton have four equal sized cells, panel 234 has an angled side edge 235 extending from the intersection of edge 220 and edge 242 to edge 258 at the bisection 259 of edge 242 and panel 238 has a straight angled edge 239 extending from the intersection of edge 224 and edge 246 to edge 262 at the bisection 263 of edge 246. Transverse interior panels 248 and 252 respectively have centrally located vertical slits 272 and 274 having end portions 362 and 364 extending respectively into bottom panels 232 and 236. As is best shown in FIGS. 12 and 13, slits 272 and 274 are adapted to slidably receive longitudinal interior panels 250 and 254 as will be described. Means for respectively attaching panels 250 and 254 to panels 252 and 248 at edges 306 and 308 are suitably provided by tabs 302 and 304 hingedly connected to panels 250 and 254 at edges 306 and 308.

Figure 11:
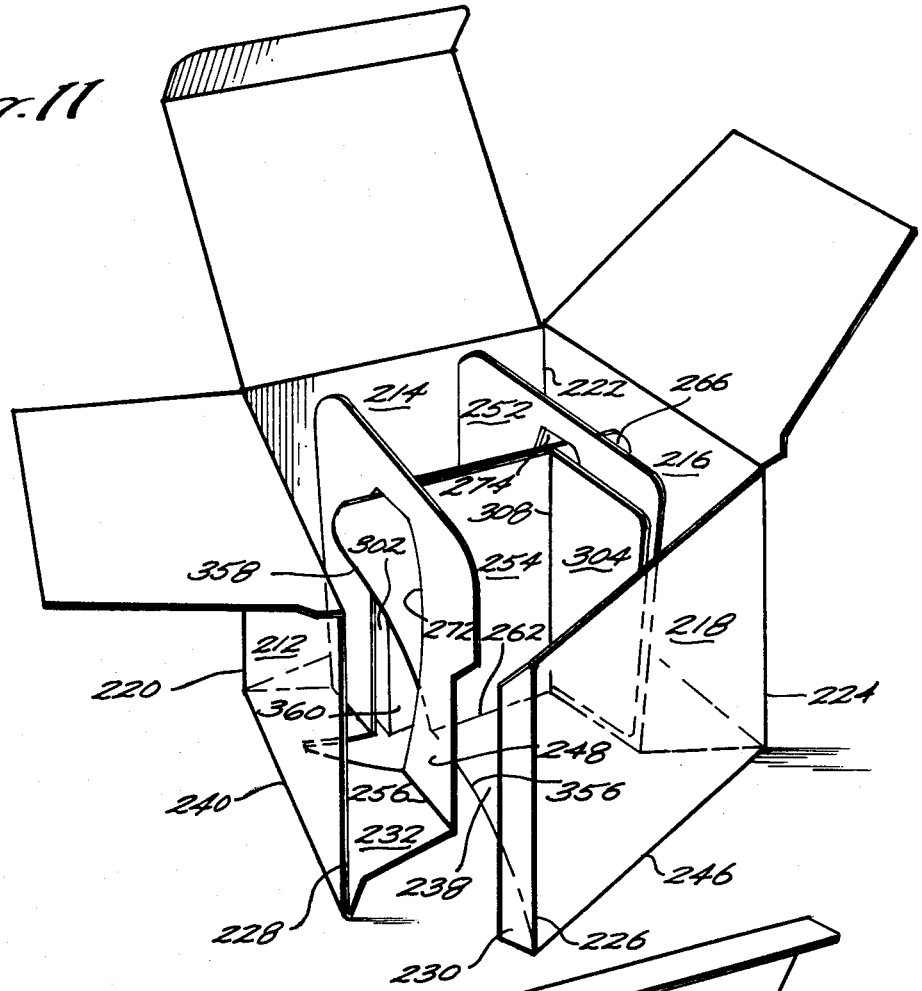
FIG. 11 is a perspective view of the blank shown in FIG. 10 folded and partially glued.

In order to assemble the carton, panels 248, 250, 252 and 254 are respectively bent over bottom panels 232, 234, 236 and 238 along respective hinges 256, 258, 260 and 262; side panels 212, 214, 216 and 218 are respectively bent over bottom panels 232, 234, 236 and 238 along respective hinges 240, 242, 244 and 246; and flaps 302 and 304 are respectively folded over panels 250 and 254 along respective hinges 306 and 308. Panel 212 is folded over panel 214 along edge 220, panel 214 is folded over panel 216 along edge 222, panel 216 is folded over panel 218 along edge 224 and flap 230 is folded over panel 218 along edge 226. The carton blank, so folded is best illustrated in FIG. 11.

Figure 15:
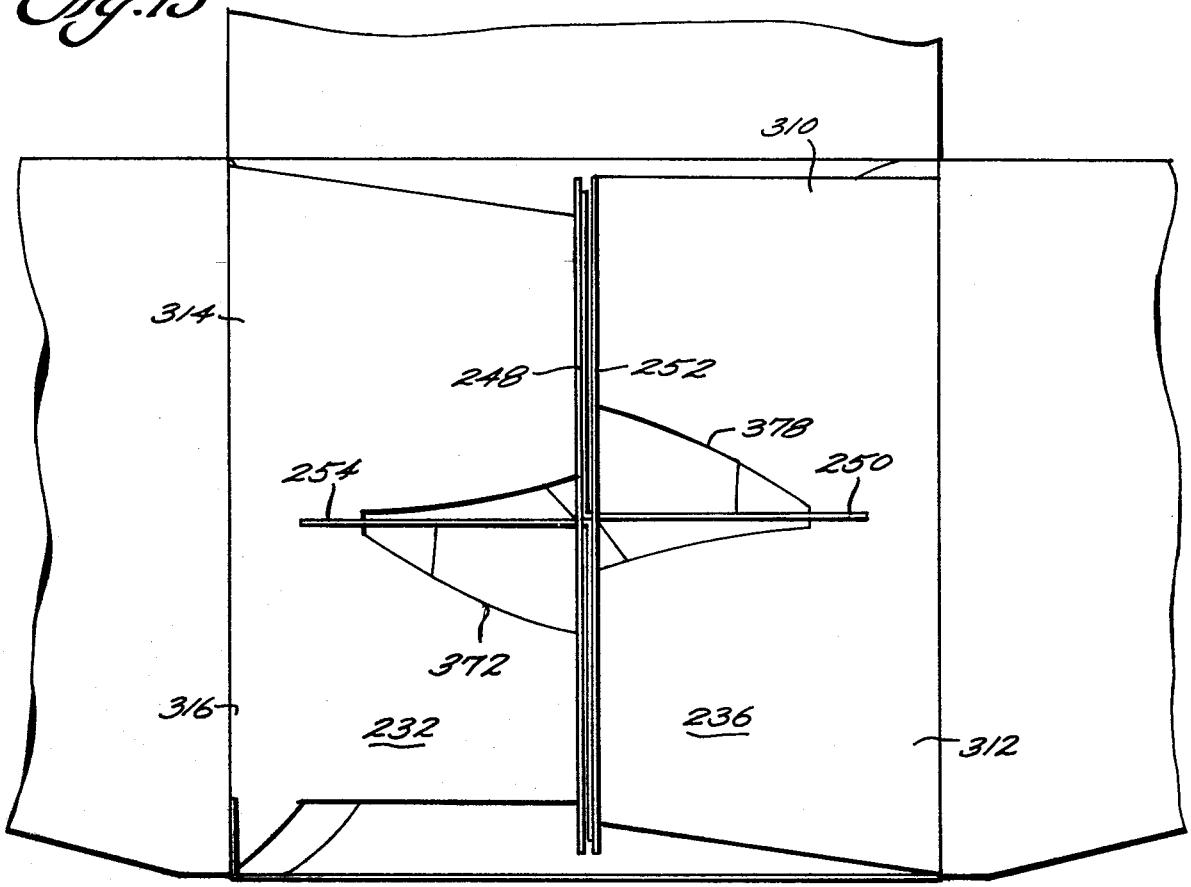
FIG. 15 is a top view of the third carton.

In order to assemble the folded blank, the respective panels 250 and 254 may first be respectively inserted through slots 274 and 272 and panels 302 and 304 suitably attached as by gluing to transverse interior panels 248 and 252 respectively. Following the above-described insertion and gluing operation, flap 230 may be fixed as by gluing to panel 212 along edge 228 to complete the structure of the carton which is best illustrated in FIGS. 12 and 15. In its open assembled state the carton has four cells 310, 312, 314 and 316. Each cell is bound on two opposing sides and its bottom by three panels connected end-to-end. Cells 310 and 312 are each bound on two opposing sides by side panel 216 and interior panel 252 and bound at its bottom by panel 236. Longitudinal interior panel 250 separates the two cells. Similarly, cells 314 and 316 are bound on two opposing sides by side panel 212 and interior panel 248 and bound at its bottom by bottom panel 232. Longitudinal interior panel 254 separates the two cells. Panels 252 and 248 are disposed back-to-back.

Figure 16:
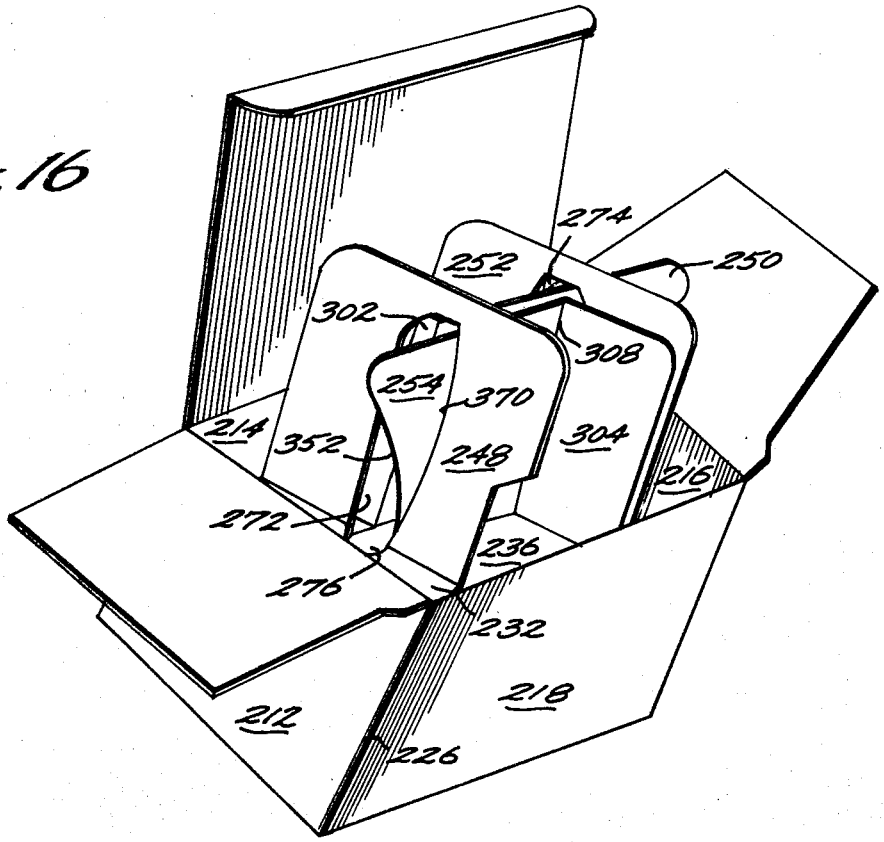
FIG. 16 is a perspective view of the third carton partially collapsed.
Figure 17:
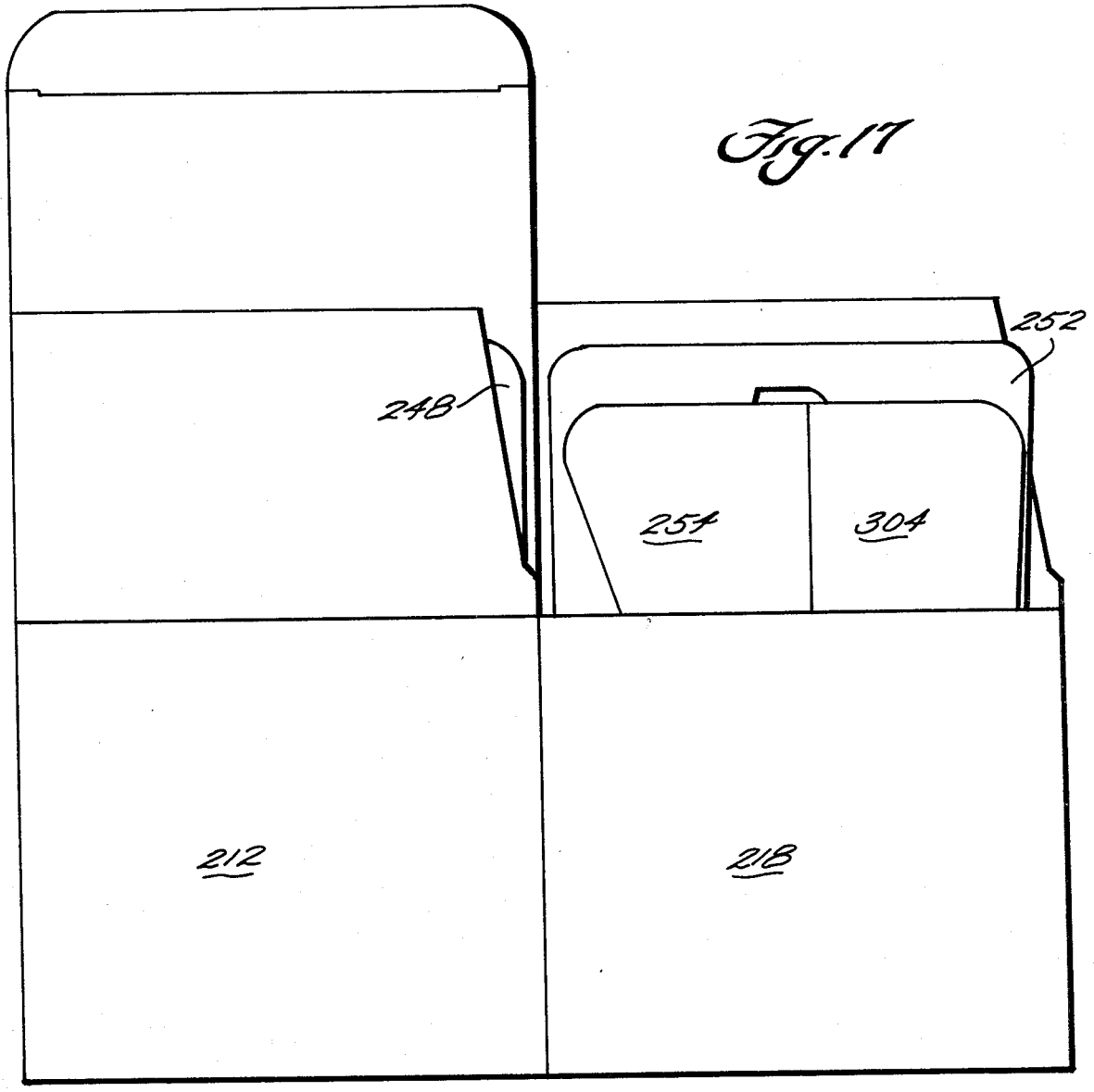
FIG. 17 is a side view of the third carton completely collapsed.

In order to collapse the carbon, a light pressure may be applied at edges 222 and 228 which causes panels 250 and 254 to respectively slide out from the spaces corresponding to cells 310, 312 and 314, 316 through respective slots 274 and 272. Concurrently, transverse interior panels 248 and 252 are caused to twist in a counterclockwise direction, bottom panels 232 and 236 respectively rotate upward about hinges 240 and 244, bottom panels 234 and 238 are respectively bent upward about hinges 242 and 246 until panels 250 and 254 are respectively completely removed from slots 274 and 272, and the various interior and bottom panels are flattened against the corresponding panel which they connectedly oppose when the carton is in its open position. During this collapsing operation, angular edges 235 and 239 of bottom panels 234 and 238 respectively apply substantially constant upward pressure on bottom panels 232 and 236 to cause the respective panels to rotate upward in unison. A reverse action occurs when the carton is opened. The degree of consistency of the pressure will vary somewhat depending on the rigidity of the panel material. The carton in its partially and completely collapsed state is respectively shown in FIGS. 16 and 17.

The easy removal of panels 250 and 254 from and insertion into slots 274 and 272, respectively, without substantial force or bending of panels is accomplished by appropriate cutting of the respective outer edges 350 and 352 of panels 238 and 250, respective outer edges 356 and 358 of panels 238 and 254, the respective side edges 370 and 372 of vertical slot 272 and corresponding end portion 362, and respective side edges 376 and 378 of vertical slot 274 and corresponding end portion 364. The outer edges 350 and 352 of panels 234 and 250 are defined by a concave curve 354 and outer edges 356 and 358 of panels 238 and 254 are defined by a concave curve 360. The shapes of respective side edges 370 and 372 of vertical slots 272 and corresponding end portion 362 are defined by a continuous convex curve 374 as is best illustrated in FIG. 10. Respective side edges 376 and 378 of vertical slot 274 and corresponding end portion 364 are similarly defined by convex curve 380. Tests and calculations have shown that if curves 354, 360, 374, and 380 are of proper identical curvature, curves 352 and 360 of their corresponding panels will slide along the respective corresponding curves 374 and 380 of their corresponding panels the latter acting as a cam to guide panels 250 and 254 through slots 274 and 272 without hangups or substantial bending of panels. The length of edges 258 and 262 can be made equal to at least one half the length of the side bottom edges 242, 246 and top edges 298 and 300 so that objects such as glasses placed in each cell will be protected from contacting one another.

What is claimed is:

1. A collapsible multicell rectangular carton having a collapsed state and an assembled state and being slidably transformable being said states, and formed from an integral blank, said carton comprising:

four side panels including first, second, third and fourth rectangular side panels each having opposing top and bottom edges and two opposing end edges consecutively hingedly connected together in linear end-to-end relation; the distance between the side edges of said first and third side panels and being substantially equal and the distance between the side edges of said second and fourth side panels being substantially equal;

means for hingedly securing together the free ends of said first and fourth side panels;

first, second, third and fourth bottom panels are first, second, third and fourth interior panels respectively corresponding to said first, second, third and fourth side panels to form a rectangular enclosure when said carton is in its assembled state.

said first and third bottom panels each having an outside face, and having opposing inside and outside edges and opposing free side edges, said first and third bottom panels respectively hingedly connected at their inside edges to said first and third side panel bottom edges;

said first and third interior panels each having opposing free side edges and opposing top and bottom edges, respectively hingedly connected at their bottom edges to said first and third bottom panel inside edges;

said second and fourth bottom panels each having opposing an inside edge and an outside edge, said second and fourth bottom panels being respectively hingedly connected at said outside edge to said second and fourth bottom side panel bottom edges, said second and fourth bottom panels being disconnected to said first and third bottom panels, said second and fourth panels each having angled side edge means for pressing different ones of said first and third inside panel outside faces upward when said carton is being collapsed;

said second and fourth interior panels each having an inside and an outside portion, each said inside portion having an inside edge, each said outside portion having a free outside edge, each said portion having a lower edge and a free upper edge, said outside portion lower edge comprising a free edge, said second and said fourth interior panels being respectively hingedly connected at their inside portion lower edges to said second and fourth bottom panel inside edges;

each of said hinged interior panel inside edges being longitudinally aligned when said carton is in its unfolded blank state;

said first and third interior panels each having a corresponding slot, each of said slots respectively having a portion extending across said first and third interior panel bottom edges into said first and third bottom panels, said slots extending sufficiently into said first and third bottom panels to permit said second and fourth interior panel outside portions to slide outwardly of said slots without substantially bending when said carton side panels are collapsed;

said first panel slot slidably receiving one of said second and fourth interior panel outside portions, and said third panel slot slidably receiving the other of said second and fourth interior panel outside portions, when said rectangular side panels are hingedly folded in generally vertical rectangular relation to form the sides of said carton, each of said bottom panels are hingedly folded inwardly, perpendicular to its corresponding side panel and each of said interior panels are hingedly folded into confronting parallel relation to its corresponding side panel;

means for hingedly fixing said second interior panel at its inner portion inside edge to that one said first and third interior panels having the slot means for slidably receiving said fourth interior panel outside portion;

and means for hingedly fixing said fourth interior panel at its inner portion inside edge to that one said first and third interior panels having the slot means for slidably receiving said second interior panel outside portion.

2. A collapsible multicell rectangular carton having a collapsed state and an assembled state and being slidably transformable being said states, and formed from an integral blank, and carton comprising:

four side panels including first, second, third and fourth rectangular side panels each having opposing top and bottom edges and two opposing end edges hingedly consecutively connected together in linear end-to-end relation; the distance between the side edges of said first and third side panels being equal and the distance between the side edges of said second and fourth side panels being equal;

means for hingedly securing together the free ends of said first and fourth side panels;

first, second, third and fourth bottom panels and first, second, third and fourth interior panels respectively corresponding to said first, second, third and fourth side panels to form a rectangular enclosure when said carton is in its assembled state.

said first and third bottom panels each having an outside face, and having opposing inside and outside edges and opposing free side edges, said first and third bottom panels respectively hingedly connected at their inside edges to said first and third side panel bottom edges;

said first and third interior panels each having opposing free side edges and opposing top and bottom edges, respectively hingedly connected at their bottom edges to said first and third bottom panel inside edges;

said second and fourth bottom panels each having opposing an inside edge and an outside edge, said second and fourth bottom panels being respectively hingedly connected at said outside edge to said second and fourth side panel bottom edges, said second and fourth bottom panels being disconnected to said first and third bottom panels, said second and fourth panels each having angled side edge means for pressing different ones of said first and third inside panel outside faces upward when said carton is being collapsed;

said second and fourth interior panels each having an inside and an outside portion, each said inside portion having an inside edge, each said outside portion having a free outside edge, each said portion having a lower edge and a free upper edge, said outside portion lower edge comprising a free edge, said second and said fourth interior panels being respectively hingedly connected at their inside portion lower edges to said second and fourth bottom panel inside edges;

each of said hinged interior panel inside edges being longitudinally aligned when said carton is in its unfolded blank state;

said four side panels surrounding said four interior panels and said four bottom panels when said free edges first and fourth side panel edges are hingedly secured together, said first and third interior panels each having corresponding slot means for slidably receiving second and fourth interior panel outside portions each of said first, second, third and fourth interior panels being in parallel spaced confronting relationship with said corresponding side panel, to form at least 4 cells said second and fourth interior panels substantially defining and said first, second, third and fourth bottom panels define a single horizontal plane forming a base a single longitudinal partition formed in a single longitudinal plane, when said carton is in its assembled state.

said first and third bottom panels having corresponding slots connected respectively to said first and third interior panel slot means, said first and third bottom panels including cam means, responsive to opposing pressures applied at catercorner hinged side edges of said side panels, including an edge of each of said bottom panel slots, for guiding said second and fourth panel outside portions into and out of said interior panel slots to transform said carton into said assembled and collapsed states;

means for hingedly fixing said second interior panel at its inner portion inside edge to that one said first and third interior panels having the slot means for slidably receiving said fourth interior panel outside portion; and means for hingedly fixing said fourth interior panel at its inner portion inside edge to that one said first and third interior panels having the slot means for slidably receiving said second interior panel outside portion.

3. A carton as in claim 2 wherein each of said first and third bottom panel includes cam means, including the edges of the portion of said slot in each corresponding bottom panel, for guiding said second and fourth interior upward and through said slots when said carton side panels are collapsed.

4. A carton as in claim 1 or claim 3 wherein the distance between said inside and outside edges in each of said first and third bottom panels being approximately equal to the length of said side panel bottom edges so that said first and third interior panels are in confronting abutting relation forming a single transverse partition wall when in a transverse plane said carton is in its assembled state; said transverse partition and said longitudinal partition defining the interior side boundaries of four cells.

5. A carton as in claim 4 wherein said each cam means bottom panel slot edge is convexly curved in relation to said slot each of said second and fourth interior panel outside edges and one of the side edges of the corresponding bottom panel having a concave portion which extends across the corresponding interior panel bottom edge, said convex slot edge and said bottom panel concave edge portion cooperating in abutting relation to guide said second and fourth slidably interior panel outside portions through said first and third interior panel slots.

6. A carton as in claim 1 or claim 2 wherein said first and said second side panels and said first and second inside panels are respectively shaped identical to said third and said fourth side panels and said third and said fourth inside panels.

7. A carton as in claim 2 wherein said means for hingedly fixing said second and said fourth interior panels at their respective inner portion inside edges comprise interior hinged panel portions each said interior hinged panel portion having an inside side edge and a free outside side edge, said hinged interior panel portion inside side edge being hingedly connected to said interior panel inner portion inside edge, each said interior hinged panel portion being fixed in confronting parallel abutting relationship to one of said slotted interior panels.

8. A collapsible six cell carton formed from an integral blank comprising:

first, second, third and fourth rectangular side panels each having opposing top and bottom edges and two opposing end edges hingedly consecutively connected together in linear end-to-end relation;

means for hingedly securing together the free ends of said first and fourth side panels;

first and third bottom panels, each having an outside force, and having opposing inside and outside edges and opposing free side edges, said first and third bottom panels being respectively hingedly connected at their inside edges to said first and third side panel bottom edges;

first and third interior panels, each having opposing free side edges and opposing top and bottom edges, respectively hingedly connected at their bottom edges to said first and third bottom panel inside edges;

said first and third interior panels each having opposing free side edges and opposing top and bottom edges, respectively hingedly connected at their bottom edges to said first and third bottom panel inside edges;

said second and fourth bottom panels each having opposing an inside edge and an outside edge, said second and fourth bottom panels being respectively hingedly connected at said outside edge to said second and fourth side panel bottom edges, and being disconnected to said first and third bottom panels, said second and fourth panels each having angled side edge means for pressing different ones of said first and third inside panel outside faces upward when said carton is being collapsed;

second and fourth interior panels each having an inside and an outside portion, each said inside portion having an inside edge, each said outside portion having a free outside edge, each said portion having a lower edge and a free upper edge, said outside portion lower edge comprising a free edge, said second and said fourth interior panels being respectively hingedly connected at their inside portion lower edges to said second and fourth bottom panel inside edges;

each of said hinged interior panel inside edges being longitudinally aligned when said carton is in its unfolded blank state;

said first and third interior panels each having a corresponding slot, each of said slots respectively having a portion extending across said first and third interior panel bottom edges into said first and third bottom panels, said slots extending sufficiently into said first and third bottom panels to permit said second and fourth interior panel inside portions to slide outwardly of said slots without substantially bending when said carton side panels are collapsed;

said first panel slot slidably receiving one of said second and fourth interior panel inside portions, and said third panel slot slidably receiving inside portions, when said rectangular side panels are hingedly folded in generally vertical rectangular relation to form the sides of said carton, each of said bottom panels are hingedly folded inwardly, perpendicular to its corresponding side panel and each of said interior panels are hingedly folded into confronting parallel relation to is corresponding side panel;

means for hingedly fixing said second interior panel at its inner portion inside edge to that one said first and third interior panels having the slot slidably receiving said fourth interior panel outside portion; and means for hingedly fixing said fourth interior panel at its inner portion inside edge to that one said first and third interior panels having the slot slidably receiving said second interior panel outside portion.

9. A carton as in claim 8 wherein each of said bottom panel portions of said slots has a generally "V" shape, the bottom of the "V" pointing toward the corresponding side bottom edge, the sides of the "V" bowing toward each other.

10. A carton as in claim 8 or claim 9 wherein said first and second side panels and said first and second inside panels are respectively shaped identical to said third and said fourth side panels and said third and said fourth inside panels.

11. A carton as in claim 8 wherein said slots are respectively substantially centrally located between the side edges of said first and third interior panels; and said hinged second and fourth bottom panel inside edges respectively extending parallel to and in confronting relationship to substantially only the middle third of said second and fourth bottom panel outside edges, so that when said carton is in its assembled state said interior panels and said side panels form six approximately equal size cells, said second and fourth interior panel inner portions being in confronting relation in forming a single wall between two adjacent cells.

12. A carton as in claim 8 or claim 9 or claim 11 wherein:

said slots are respectively centrally located between the side edges of said first and third interior panels; and said second and said fourth bottom panel edges respectively substantially form the shape of an isosceles trapezoid, the shorter and longer parallel edges of said trapezoids respectively forming the inner and outer edges of said second and fourth bottom panels, so that when said carton is in its assembled state, interior panels and said side panels form six approximately equal size cells, said second and fourth interior panel inside portions being in confronting relationship and forming a single wall between two adjacent cells.

13. A carton as in claim 9 wherein said means for hingedly fixing said second and said fourth interior panels at their respective inner portion inside edges comprise interior hinged panel portions, substantially the same shape as said second and fourth interior panel outside portions;

each said interior hinged panel portion having an inside side edge and a free outside side edge, said hinged interior panel portion inside side edge being hingedly connected to said interior panel inner portion inside edge, each said interior hinged panel portion being fixed in confronting parallel abutting relationship to one of said slotted interior panels.

14. A collapsible carton as in claim 11 wherein said second and said fourth bottom panel edges respectively substantially form the shape of an isosceles trapezoid, the shorter and longer parallel edges of said trapezoids respectively forming the inner and outer edges of said second and fourth bottom panels.

15. A collapsible carton as in claim 14 further comprising one or more flaps individually hingedly attached to said side panel top edges.

16. A collapsible carton as in claim 15 further comprising at least one flap hingedly individually attached to at least one of said first and third interior panel upper edges.

17. A collapsible six cell carton formed from an integral blank comprising:

first, second, third and fourth rectangular side panels each having opposing top and bottom edges and two opposing end edges hingedly consecutively connected together in linear end-to-end relation;

means for hingedly securing together the free ends of said first and fourth side panels;

first and third bottom panels, each having an outside force, and having opposing inside and outside edges and opposing free side edges, said first and third bottom panels being respectively hingedly connected at their inside edges to said first and third side panel bottom edges;

first and third interior panels, each having opposing free side edges and opposing top and bottom edges, respectively hingedly connected at their bottom edges to said first and third bottom panel inside edges;

said first and third interior panels each haing opposing free side edges and opposing top and bottom edges, respectively hingedly connected at their bottom edges to said first and third bottom panel inside edges;

said second and fourth panels each having opposing an inside edge and an outside edge, said second and fourth bottom panels being respectively hingedly connected at said outside edge to said second and fourth side panel bottom edges, said second and fourth panels each having angled side edge means for pressing different ones of said first and third inside panel outside faces upward when said carton is being collapsed;

second and fourth interior panels, each panel having an inside and an outside portion, each said inside portion having an inside edge, each said outside portion having a free outside edge, each said portion having a lower edge and a free upper edge, said outside portion lower edge comprising a free edge, said second and said fourth interior panels being respectively hingedly connected at their inside portion lower edges to said second and fourth bottom panel inside edges;

each of said hinged interior panel inside edges being longitudinally aligned when said carton is in its unfolded blank state;

said first and third interior panels each having a corresponding slot, each of said slots respectively having a portion extending across said first and third bottom panels, said slots extending sufficiently into said first and third bottom panels to permit said second and fourth interior panel inside portions to slide outwardly of said slots without substantially bending when said carton side panels are collapsed;

said first and third bottom panels including cam means including means, resposive to opposing pressures applied at catercorner hinged side edges of said side panels, including an edge of each of said slot bottom portions, for guiding said second and fourth panel outside portions into and out of said interior panel slots to transform said carton into said assembled and collapsed state;

said first panel slot slidably receiving one of said second and fourth interior panel outside portions, and said third panel slot slidably receiving the other of said second and fourth interior panel outside portions, when said rectangular side panels are hingedly folded in generally vertical rectangular relation to form the sides of said carton, each of said bottom panels are hingedly folded inwardly, perpendicular to its corresponding side panel and each of said interior panels are hingedly folded into confronting parallel relation to is corresponding side panel;

means for hingedly fixing said second interior panel at its inner portion inside edges to that one said first and third interior panels having the slot slidably receiving said fourth interior panel outside portion; and means for hingedly fixing said fourth interior panel at its inner portion inside edge to that one said first and third interior panels having the slot slidably receiving said second interior panel outside portion.

18. A carton as in claim 17 wherein each of said bottom panel portions of said slots has a generally "V" shape, the bottom of the "V" pointing toward the corresponding side bottom edge, the sides of the "V" bowing toward each other.

19. A carton as in claim 8 or claim 9 or claim 17 or claim 18 wherein said second and fourth interior panel outside portion lower edge each extends adjacent to and parallel to a respective one of said first and third bottom panels said second and fourth interior panel outside portion lower edges each extending substnatially from the outside edge to the inside edge of said respective one of said first and third bottom panels when said carton is in its assembled state so that one of the faces of each of said second and fourth panel outside portions slides on said edge of said slot bottom portion of said respective one of said first and third bottom panels when said carton is being assembled or being collapsed.

* * * * *